US005575121A

United States Patent [19]

Lajaunie

[11] Patent Number: 5,575,121

[45] Date of Patent: Nov. 19, 1996

[54] SOUND BARRIER WALL CONSTRUCTION USING TIRE SECTIONS

[76] Inventor: Philippe Lajaunie, 135 Wooster St., New York, N.Y. 10012

[21] Appl. No.: 399,430

[22] Filed: Mar. 7, 1995

[51] Int. Cl.[6] ..... E04B 1/84

[52] U.S. Cl. ..... 52/144; 52/DIG. 9; 181/210

[58] Field of Search ..... 52/144, DIG. 9; 404/6; 405/30; 181/284, 294, 210; 256/13.1, DIG. 6

[56] References Cited

U.S. PATENT DOCUMENTS

| | | | |
|---|---|---|---|
| 4,188,153 | 2/1980 | Taylor | 52/DIG. 9 X |
| 4,785,577 | 11/1988 | Lederbauer | 52/DIG. 9 X |
| 5,172,528 | 12/1992 | Clarke | 52/DIG. 9 X |
| 5,359,819 | 11/1994 | Beyler | 52/144 |

*Primary Examiner*—Carl D. Friedman
*Assistant Examiner*—Christopher Todd Kent
*Attorney, Agent, or Firm*—Cohen, Pontani, Lieberman, Pavane

[57] ABSTRACT

A wall-like sound barrier for placement along the shoulders of a highway is formed of a plurality of arcuate tire sections arranged in stacked rows to define a vertically-extending wall of such tire sections. The concave, partly open face of each tire section is oriented in confronting opposition to a source of sound or noise to be damped and reflected, such as a roadway. Each tire section may be inclined so as to encourage runoff of rainwater and the like that could otherwise collect in the interior of the tire section. The inclination may be defined by orienting each tire section so that its convex exterior is elevated above its concave interior, and/or by orienting each tire section so that one of its ends is elevated above the other of its ends. In addition, the tire sections foxing each row may be arranged so that the tire sections are vertically aligned from one row to the next to form columns of tire sections in the resulting wall, or may be staggered from row-to-row so that each tire section lies immediately above portions of two tire sections of the row of tire sections upon which it is stacked.

13 Claims, 4 Drawing Sheets

SOUND BARRIER WALL CONSTRUCTION USING TIRE SECTIONS

FIELD OF THE INVENTION

This invention relates generally to sound barriers and, more particularly, to wall-like barriers for placement along the sides or shoulders of highways, construction sites and airports and the like.

BACKGROUND OF THE INVENTION

Sound barriers are becoming increasingly important for assuring homeowners and potential homeowners and residents proximate major roadways of the ability to peaceful enjoyment of an urban lifestyle. In densely populated suburbia, new residences are now being built in areas that were once deemed undesirable such, for example, as those immediately adjacent to high-speed expressways. Purchasers of these new residences soon become intolerant of the constant bombardment of noise from highway vehicles and travellers and often barrage local authorities with requests to erect expensive sound barriers.

In another instance, construction must at times be carried out in heavily populated areas. Typically, such construction sites are merely surrounded by a wooden or chain link fence formed of a single layer of thin plywood or of metal wire. Construction noise is rarely attenuated by such fences since their primary purpose is to keep trespassers from wandering onto the construction site, rather than preventing machinery noise from projecting outward therebeyond.

In yet another common situation, sound barriers may be employed around sections of airports where intense aircraft engine noise is desirably attenuated. The impact-absorption qualities of such sound barriers are also an important consideration because of the possibility of an out-of-control aircraft careening into the barriers.

To attain their sound absorption qualities, sound barriers often make use of the damping characteristics of certain constituent materials and/or the geometric configurations of their surfaces. The constituent materials may include plastic foam, shredded rubber, sponge, fibers, or any aggregation thereof. These materials are typically encapsulated within an outer shell such, for example, as an aluminum extrusion. The surface geometries of the sound barrier may also include numerous holes and/or gaps so that sound can be trapped and/or absorbed within the sound barrier. Such barriers, however, suffer the disadvantages of relatively high cost and susceptibility to degradation over a short period of time in an environment exposed to the elements.

A particularly common form of sound barrier in use today is that constructed of concrete or masonry, a design that is relatively simple as compared to those previously discussed. Such barriers operate primarily by reflecting sound back toward the roadway; sound absorption or damping is minimal with such barriers and, indeed, is not generally their major intended utility.

Unit cost of a sound barrier is of paramount concern since the barriers must typically extend for at least long sections, often of many miles, of high-speed roadways. Barriers of complex or extravagant structure or requiring highly labor-intensive installation are accordingly generally considered commercially impractical.

Various sound barrier structures are disclosed in the U.S. patented art. For example, the Coburn patent (U.S. Pat. No. 4,643,271) discloses a sound barrier wall construction comprising a plurality of wire cages containing a mixture of crushed stones and shredded tires. Coburn teaches that the crushed stones serve as ballast while the shredded tires provide both sound and shock absorbing qualities.

The Schmanski patent (U.S. Pat. No. 5,272,284) similarly discloses a sound barrier wall comprising a plurality of containment panels or members, each of which is filled with a resilient composite made up of shredded tires (i.e. "rubber chips") and binder materials such as thermosetting resins.

These prior art structures, however, require a great deal of labor, and corresponding expense, to acquire and prepare the materials from which the barrier is constructed and to form the barrier from such materials.

SUMMARY OF THE INVENTION

The present invention is directed to wall-like sound barriers formed of sectioned tires such, for example, as half-tires defining arcuate tire sections that are vertically stacked one atop the other so that the open, inner surfaces of the sectioned tires face the highway or noise-generating source. In this arrangement, substantial amounts of noise from the highway or other source are advantageously trapped and absorbed by the open, inner surfaces of the tire sections, while the remaining unabsorbed sound is reflected back toward the noise generating site such, for example, as a highway. The stacked tire sections are, in addition, preferably oriented so that they lie at a relatively small angular incline whereby moisture such as rainwater will drain off from, rather than collect within, the open interior of each tire section. The stacked tire sections may be further enclosed within a mesh or set of fences or positionally secured to each other by, for example, a cage or gabion or the like.

The present invention has the significant advantage of providing substantial noise reduction about and along high-speed roadways, construction sites, airports and the like while reusing or recycling worn tires which have heretofore been regarded as relatively useless and environmentally undesirable articles. Another advantage of the invention lies in the noteworthy durability of the inventive sound barriers by virtue of the extremely slow and minimal degradation of the rubber compounds in the tires, even when continuously exposed to environmentally harsh conditions. Yet another advantage is the fact that the invention alleviates overburdened landfills of worn tires. Still another advantage is that the invention provides a practical and inexpensive sound barrier construction.

Other features and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF THE DRAWINGS

In the drawings, wherein like reference characters denote similar elements throughout the several views.

DETAILED DESCRIPTION OF THE PREFERRED EMBODIMENTS

Figure 1:
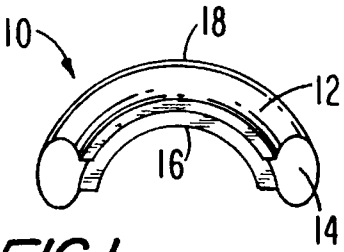
FIG. 1 is a perspective view of a vehicle tire section for use in a sound barrier wall constructed in accordance with the present invention.

As seen in FIG. 1, a tire section 10 for use in a most preferred form of the present invention is formed by cutting a whole tire—as of a car or truck or other vehicle—in a direction generally transverse to the arcuate side wall 12 of the whole tire or, put another way, through and substantially perpendicular to the rotative plane of the tire. To maintain at least a rough uniformity of the tire sections 10 of which the inventive sound barrier is constructed, it is most preferred that automobile tires be employed in forming the tire sections. It is generally contemplated that the tire from which a section 10 is defined be a worn or used or discarded tire that is no longer needed or useful for operatively supporting a vehicle, although those skilled in the art will recognize that the age or condition of the tire from which such sections 10 are cut or otherwise formed is not, for the most part, relevant to its ability to be employed in accordance with the invention. It is further anticipated that the sections 10 be formed from tires comprised at least in part of rubber, although here too tires constructed of other materials may be utilized so long as the material provides sufficient structural rigidity and sound absorbing and reflective properties as will hereinafter become apparent.

Figure 6:
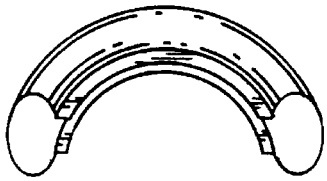
FIG. 6 is an elevated perspective view of a vehicle tire arcuate segment of approximately 120° for use in the sound barrier wall construction of the invention.

Each tire section 10 thus formed is shown as having a substantially semi-circular shape defining an arc of approximately 180°, as in a most preferred form of the invention each whole tire is cut approximately in half to provide two generally like-sized sections 10. Thus, in this preferred configuration the cutting of each whole tire is effected along or substantially perpendicular to a full diameter of tire, i.e. along the largest width within the rotative plane of the tire. Embodiments in which, by way of nonlimiting example, a whole tire is cut in thirds to provide three such tire sections 10, each defining an arc of approximately 120° as shown in FIG. 6, or in which each tire is cut so as to define differently-sized segments or arcs, are also within the intended scope and contemplation of the invention. In each such variation, however, it is generally intended that the tire be cut so as to maintain the arcuate, concavely-open tire wall configuration which is defined by the vehicle-supporting tread portion and the opposed tire sidewalls that unitarily extend from the lateral sides of the tire tread. As seen in FIG. 1, each tire section 14 thus includes an open, generally arcuate inner surface 14, a pair of opposed concave edges defining a concave portion 16 facing the forward direction (in FIG. 1), and an outer face or convex portion 18 facing the rearward direction.

Figure 2:
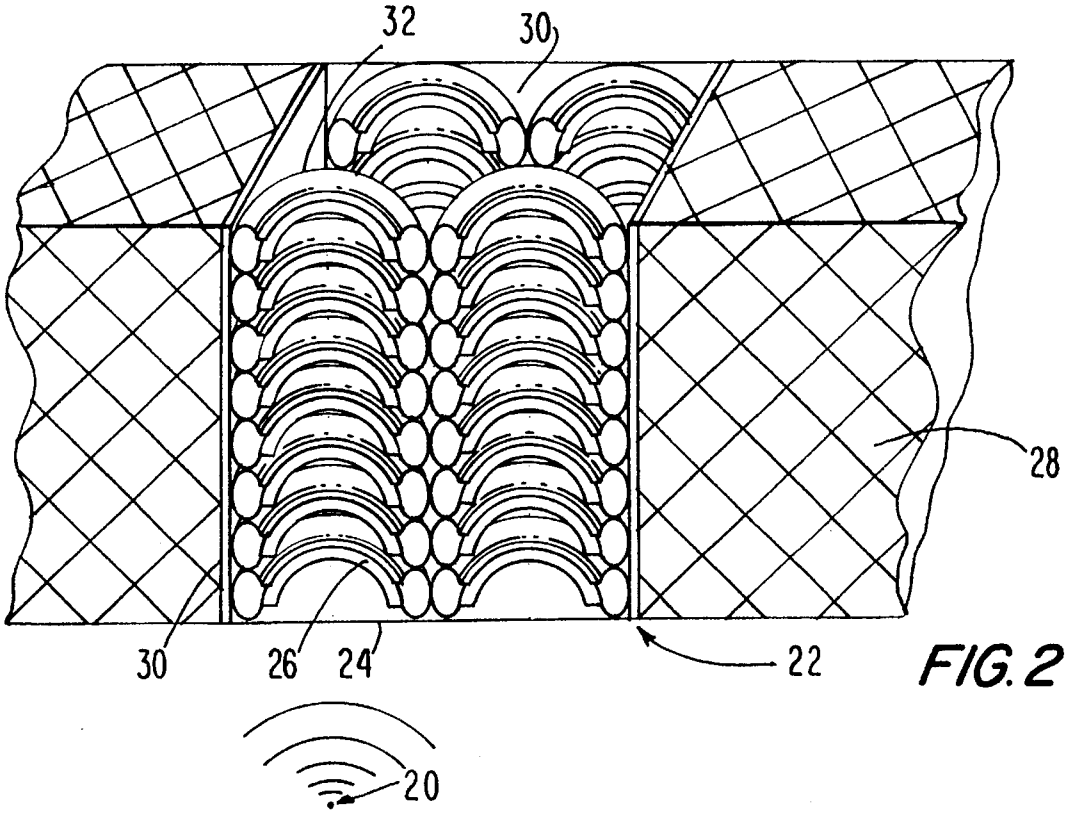
FIG. 2 is an elevated from perspective view of a preferred embodiment of a sound barrier constructed in accordance with the invention and employing half-tire sections.
Figure 5:
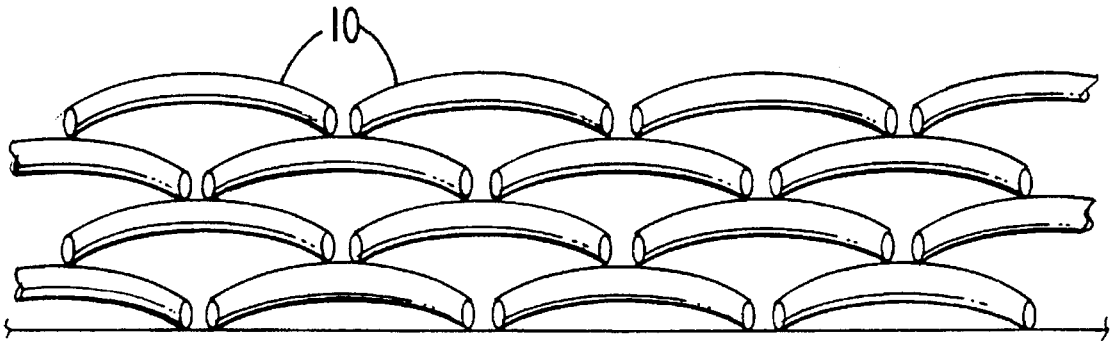
FIG. 5 is a front view, partly broken away, of a still further embodiment of a sound barrier construction in accordance with the invention.

A sound barrier wall 22 formed of a plurality of such tire sections 10 in accordance with the present invention is shown in FIG. 2 in association with a noise generating or other sound source 20. The noise source 20 may, for example, be vehicles moving on and along a highway, in which case it is generally anticipated that one or more walls 22 be located along the lateral edges or sides or shoulders of the highway. As seen in FIG. 2, the sound barrier wall 22 is formed by placing a plurality of tire sections 10 one adjacent the next in a linear fashion atop a support surface, with each tire section 10 oriented so that its concave portion and inner surface 14 faces or confronts the noise generating source 20—e.g. the roadway. This construction forms a first row 24 of tire sections 10. A second row 26 of tire sections 10, and successive rows stacked thereupon and above, is similarly formed by placing a plurality of tire sections 10 atop the immediately underlying tire sections forming the immediately underlying row, thus building up and defining a substantially vertical wall-like structure. It should be pointed out that although the tire sections 10 forming each successive row are shown as arranged with each tire section lying immediately above and in substantially end-to-end alignment with the next to define a series of aligned columns of tire sections, alternate arrangements in which the tire sections 10 forming one row are longitudinally staggered relative to those forming the immediately adjacent row—i.e. so that each tire section 10 lies immediately above portions of two tire sections forming the adjacent row, as for example in FIG. 5—are also within the intended scope of the invention. The height of the barrier 22 may of course be varied by selectively utilizing as many rows of tire sections 10 as may be desired or appropriate for a particular application.

As will be apparent, the sectioned tires of each column may optionally be secured to each other through mechanical fasteners such, for example, as by a combination of studs and nuts. Thus, a plurality of threaded studs may be journalled through pre-drilled apertures in each tire section 10 to clamp adjacent sections 10 together by attaching and engaging appropriate washers and nuts and the like from one or opposite ends of the studs. Other, alternate or supplemental forms of adhesion or securement of the tire sections to each other, and/or to any associated supporting structures or bases or the like, may also be employed as appropriate to a particular environment or as a general matter of design choice.

It is also generally preferred and intended that a sound barrier wall formed in accordance with the invention include some structure for surrounding or enveloping the stacked tire sections 10 that form the vertically-extending barrier, as for example to improve the appearance of the barrier. Toward that end, the stacked tire sections may be enclosed within a fence formed of a metal wire or mesh or the like, such as a chain-link fence or so-called chicken wire fencing 28. Such wire fencing 28 is preferably placed along both the front and rear surfaces of the tire section wall and, optionally, over and along the top of the wall, and may be anchored or retained in position by posts 30 located at appropriate intervals along the sound barrier wall. Such fencing may, of course, alternatively be formed of other, nonmetallic materials as general matters of cost, availability, appearance and design choice. Arrangements of this type are primarily intended to be constructed in situ, i.e. at the site at which the sound barrier wall is to be located for normal use in attenuating locally-generated noise.

In another contemplated form of the invention, predetermined numbers of rows of the tire sections 10 may be pre-arranged and secured to each other in transportable cages or gabions, atop suitable platforms, at a remote location for transport and set-up at the intended noise reduction site. As will be appreciated, a modular sound barrier wall 22 so constructed may be quickly and efficiently assembled at such diverse locations as construction sites and the like where sound barriers may be required for only brief or determinable periods of time, and then disassembled and transported to a new or different site for reuse.

To further diminish the escape of noise from the roadway or other noise source through the substantially unavoidable gaps between adjacently-disposed tire sections 10, a second plurality of stacked rows or layers 30 of tire sections 10 may be placed behind the first stacked rows or layers 32, i.e. so that the first rows 32 are disposed between the second rows 30 and the noise source 20; these second layers 30 are preferably offset relative to the first layers 32 such that the gaps 34 of the first layers 32 are appropriately blocked by the second layers 30. Those skilled in the art will readily appreciate that such additional layers 30, in addition to blocking the escape of noise from gaps in and between the first layers 30 of tire sections 10, also advantageously increase both the noise damping abilities of the completed wall construction and the capability of the wall structure to absorb impacts from and protect the occupants of out-of-control vehicles that come into contact with the wall 22 of the invention.

Figure 3:
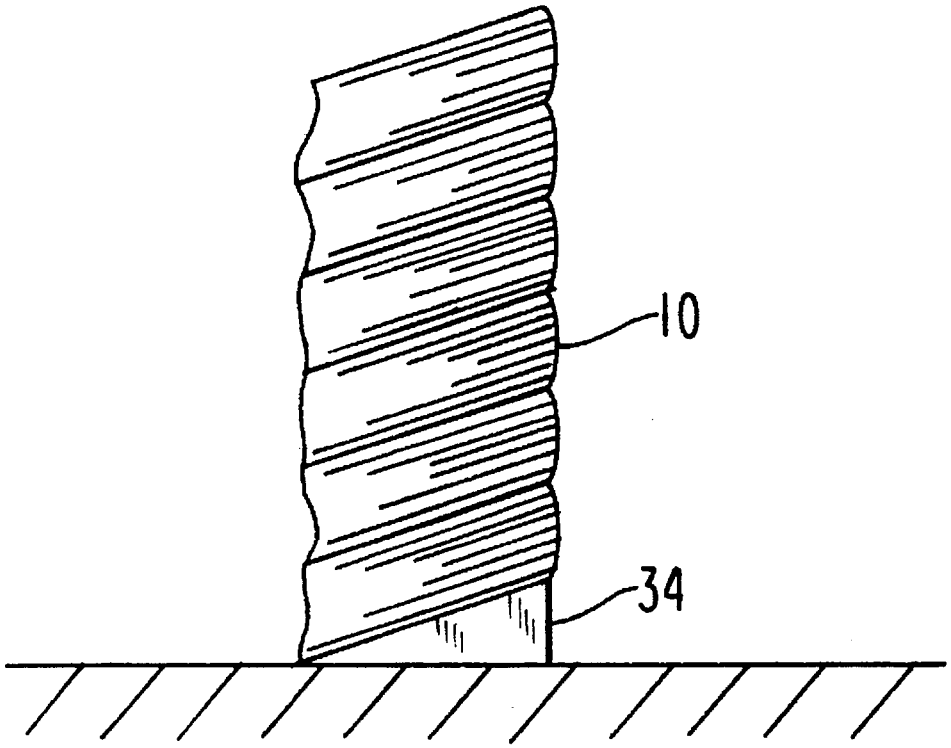
FIG. 3 is a side view of a column of half-tire sections supported by a predeterminately-angled wedge member.

In order to minimize deterioration of the tire sections 10 forming the wall 22 and prevent the undesirable accumulation of rainwater and other liquids, fluids and particulate matter within or on the arcuate interior surfaces 14 and associated portions or regions of the tire sections 10, the sections 10 are preferably disposed in an angularly-inclined orientation so that the convex portion 18 of each section is elevated above the concave portion 16 thereof. Put another way, the central portion of the arc of the convex portion 18 is disposed at an elevation higher than the elevation of the ends of the arc. In this manner, rainwater and the like will flow, under the force of gravity, out of the interiors of the tire sections 10 through, for example, the open ends of the arcuate segments forming the sections 10. As illustrated in FIG. 3, this angular inclination—which, by way of example, may be on the order of approximately 5° to 15°—may be accomplished by positioning a suitably-configured wedge-like member 34 having a predetermined inclination in supporting relation under the lowermost row 24 of tire sections 10. Where the barrier wall 22 is constructed or situated atop a supporting surface, as for example of concrete or packed soil or the like, that has been prepared or is to be utilized for the purpose of supporting such a wall, the angular orientation of the tire sections 10 may alternatively be implemented, in whole or in part, by correspondingly inclining the supporting surface so prepared or otherwise present or established.

Figure 4:
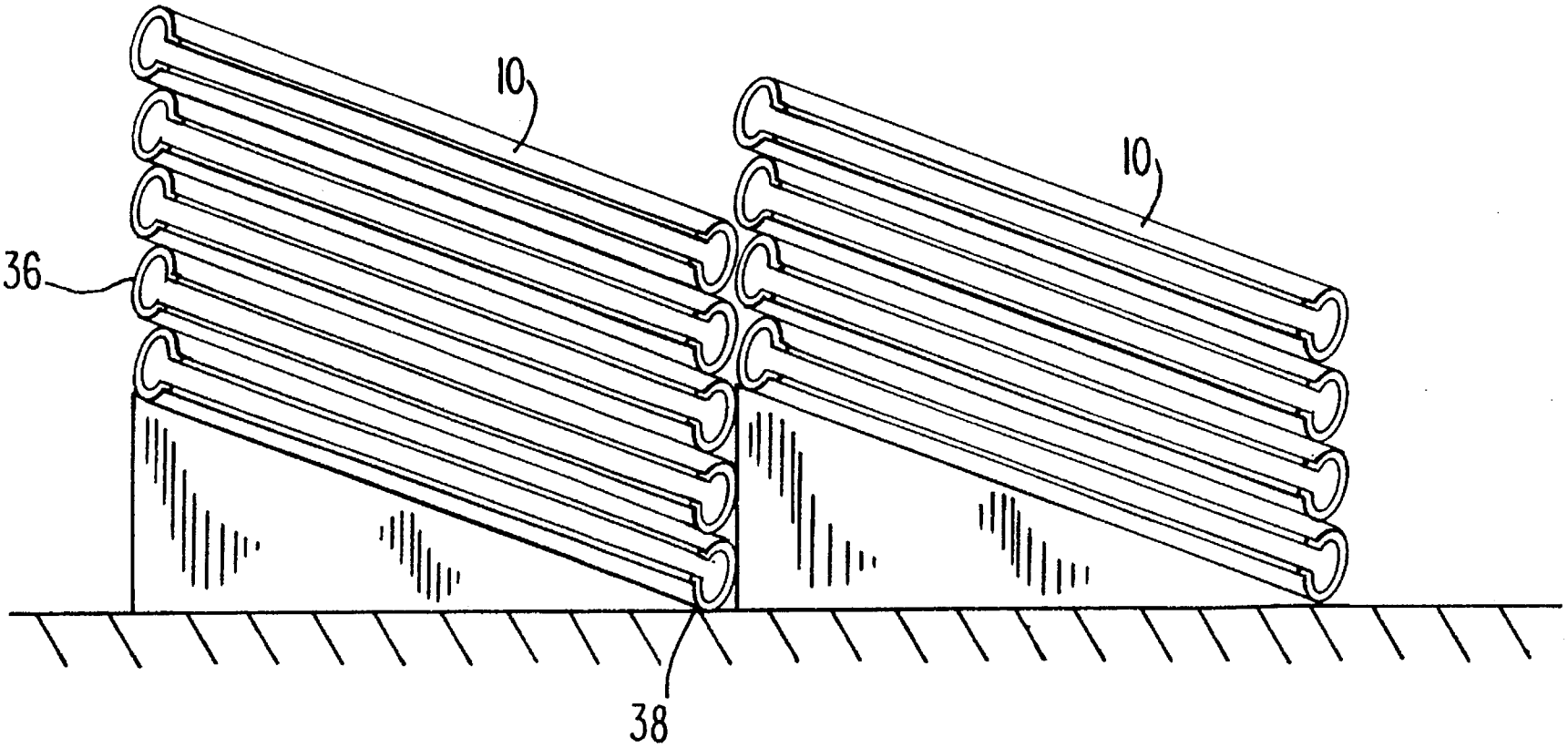
FIG. 4 is a front view of a further embodiment of a sound barrier construction in accordance with the present invention.

FIG. 4 depicts an alternate arrangement for angularly orienting the tire sections 10 of the sound barrier wall 22. As there shown, each tire section 10 is angled along its longitudinal plane—i.e. so that one of its ends 36 is positioned higher than its opposite end 38. This inclination or orientation may be implemented in any suitable manner as a general matter of design choice, as for example by providing a wedge under each tire section 10 forming the first or bottommost row of the vertically-extending wall or by appropriately shaping or configuring the underlying support surface or base or layer upon which the sound barrier wall of the invention is to be constructed or erected. The FIG. 4 arrangement, like that described in connection with FIG. 3, is also effective in preventing the accumulation of rainwater and the like within the arcuate interior of the tire sections 10; flowable liquids and the like are directed, under the force of gravity, out of the tire section interior through the lower of the two ends 36, 38.

It will also be recognized that this FIG. 4 embodiment may, in certain instances, be even more effective than the FIG. 3 arrangement in minimizing the escape or passage of noise or sound beyond the barrier wall since the opening or entry window into the arcuate interior of the concave portion 16 of each tire section 10 is effectively maximized. That is, with each tire section 10 angled in the manner depicted in FIG. 3, the plane defined between the concave lips of the concave portion 16 and into which noise from the source 20 enters the tire section is oriented at an angle, generally corresponding to the angle of inclination of the tire section, to the substantially vertical or upward elevation of the wall 22. In the FIG. 4 embodiment, on the other hand, the plane defined between the concave lips or edges of the concave portion 16 of each tire section is substantially parallel to the vertical or upward elevation of the wall 22, thus maximizing the opening or window through which noise from the source 20 will enter the tire section and thereby be prevented from escaping or passing beyond the barrier or perimeter defined by the wall 22. It should also be noted that constructions in which the tire sections 10 are angularly oriented in the manner of both of these embodiments—i.e. both from front-to-back (FIG. 3) and from end-to-end (FIG. 4)—are likewise within the intended scope and contemplation of the invention.

Thus, while there have shown and described and pointed out fundamental novel features of the invention as applied to several preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A wall-like sound barrier for absorbing and reflecting sound emanating from a source of sound so as to minimize passage of sound from the source beyond the barrier, said barrier comprising:

a plurality of tire sections arranged to form a plurality of substantially vertically stacked rows of said tire sections so as to define a substantially vertically extending wall, each said tire section comprising an arcuate segment of a vehicle tire and including an arcuate tire wall defining a substantially concave and partly open interior extending between opposed ends of said segment and a substantially convex exterior extending between said opposed segment ends, and each said row comprising a plurality of said tire sections arranged so that the substantially concave interior of each said tire section faces outwardly from the wall so that when the wall is disposed proximate a source of sound so that sound from the source enters the partly open interior of the tire section, the sound is damped by absorbed by and reflected from the tire section to thereby minimize passage of sound from the source beyond said barrier:

wherein each said tire section is oriented at a predetermined angular inclination relative to an underlying ground surface upon which said wall is constructed to encourage runoff, through at least one of the ends of each tire section, of liquids entering said partly open interior and thereby prevent accumulation of liquids in said tire section interior.

2. A wall-like sound barrier in accordance with claim 1, wherein each said tire section comprises a vehicle tire arcuate segment of approximately 180°.

3. A wall-like sound barrier in accordance with claim 1, wherein each said tire section comprises a vehicle tire arcuate segment of approximately 120°.

4. A wall-like sound barrier in accordance with claim 1, wherein the convex exterior of each said tire section is disposed at an elevation in excess of the concave interior of said each tire section so as to provide said predetermined angular inclination of said each tire section.

5. A wall-like sound barrier in accordance with claim 1, wherein one of the opposed ends of each said tire section is disposed at an elevation in excess of the other of said opposed ends of said each tire section so as to provide said predetermined angular inclination of said each tire section.

6. A wall-like sound barrier in accordance with claim 1, wherein said predetermined angular inclination is in the range of approximately 5° to 15°.

7. A wall-like sound barrier in accordance with claim 1, wherein the plurality of tire sections forming each said row are substantially vertically aligned over the plurality of tire sections forming an immediately adjacent row.

8. A wall-like sound barrier in accordance with claim 1, wherein each of the plurality of tire sections forming each said row is disposed immediately above portions of two of the tire sections forming an immediately adjacent underlying row so that the plurality of tire sections of adjacent rows are positionally staggered.

9. A wall-like sound barrier in accordance with claim 1, further comprising fence means disposed about at least a portion of said substantially vertically-extending wall of stacked tire sections for facilitating retention of said arrangement of rows of stacked tire sections.

10. A wall-like sound barrier in accordance with claim 9, wherein said fence means comprises a wire mesh disposed about at least a portion of said wall of stacked tire sections.

11. A wall-like sound barrier in accordance with claim 9, wherein said fence means comprises a cage defined about a plurality of said rows of tire sections.

12. A wall-like sound barrier in accordance with claim 1, further comprising a second plurality of tire sections arranged to form a second plurality of substantially vertically stacked rows of said tire sections so as to define a second substantially vertically extending wall, said second wall being disposed closely proximate said first wall.

13. A wall-like sound barrier for absorbing and reflecting sound emanating from a source of sound so as to minimize passage of sound from the source beyond the barrier, said barrier comprising:

a plurality of tire sections arranged to form a plurality of substantially vertically stacked rows of said tire sections so as to define a substantially vertically extending wall, each said tire section comprising an arcuate segment of a vehicle tire and including an arcuate tire wall defining a substantially concave and partly open interior extending between opposed ends of said segment and a substantially convex exterior extending between said opposed segment ends, and each said row comprising a plurality of said tire sections arranged so that the substantially concave interior of each said tire section faces outwardly from the wall so that when the wall is disposed proximate a source of sound so that sound from the source enters the partly open interior of the tire section, the sound is damped by absorbed by and reflected from the tire section to thereby minimize passage of sound from the source beyond said barrier;

wherein each of the plurality of tire sections forming each of said rows is disposed immediately above portions of two of the tire sections forming an immediately adjacent underlying row so that the plurality of tire sections of adjacent rows are positionally staggered.

* * * * *